US005573036A

United States Patent [19]

Porter et al.

[11] Patent Number: 5,573,036

[45] Date of Patent: Nov. 12, 1996

[54] ELECTRO-HYDRAULIC SERVOVALVE HAVING MECHANICAL FEEDBACK

[75] Inventors: Don B. Porter, Avra Valley; Stephen B. Currey, Tucson, both of Ariz.

[73] Assignee: Sargent Controls & Aerospace/Dover Diversified Inc., Tucson, Ariz.

[21] Appl. No.: 585,360

[22] Filed: Jan. 11, 1996

[51] Int. Cl.[6] ..... F15B 13/043

[52] U.S. Cl. ..... 137/625.63; 137/625.64

[58] Field of Search ..... 137/625.61, 625.62, 137/625.63, 625.64

[56] References Cited

U.S. PATENT DOCUMENTS

| | | | |
|---|---|---|---|
| 2,790,427 | 4/1957 | Carson | 137/625.61 |
| 2,933,106 | 4/1960 | Gerwig et al. | 91/365 X |
| 2,934,765 | 4/1960 | Carson | 137/625.61 |
| 3,339,573 | 9/1967 | Bahniuk | 137/625.64 X |
| 3,537,467 | 11/1970 | Marshall | 137/625.64 X |
| 3,580,281 | 5/1971 | Petersen | 137/625.64 X |
| 3,621,880 | 11/1971 | Jessee . | |
| 3,709,257 | 1/1973 | Faisandier . | |
| 3,747,570 | 7/1973 | Versari et al. . | |
| 4,674,539 | 6/1987 | Sloate | 137/625.64 |
| 4,762,147 | 8/1988 | Sloate . | |
| 5,031,653 | 7/1991 | Wilson et al. | 137/625.64 X |

FOREIGN PATENT DOCUMENTS

| | | | |
|---|---|---|---|
| 551168 | 12/1959 | Belgium | 137/625.63 |

*Primary Examiner*—Gerald A. Michalsky
*Attorney, Agent, or Firm*—Franklin L. Gubernick

[57] ABSTRACT

The invention is a multi-stage electro-hydraulic servovalve having a mechanical feedback between the valve's main and pilot stages. The feedback mechanism makes use of an interconnected set of linkages that transform a linear motion of the main stage slide into a rotative movement of a torque rod that can produce a translation of the pilot stage slide. Many of the linkages of the feedback mechanism are located exterior to the valve's fluid boundary and feature readily adjustable connections through which a user can adjust various parameters of the feedback such as the degree of gain and null point.

25 Claims, 4 Drawing Sheets

ELECTRO-HYDRAULIC SERVOVALVE HAVING MECHANICAL FEEDBACK

FIELD OF THE INVENTION

The invention is in the field of electro-hydraulic servovalves. More particularly, the invention is a mechanical feedback mechanism that is employed between the main and pilot stages of a multi-stage electro-hydraulic servovalve. The mechanism includes a plurality of adjustably connected linkages that transform linear motion of the main stage slide into a rotative movement of a torque rod. The torque rod is operatively connected to a cam that is capable of causing a translation of the pilot stage slide.

BACKGROUND OF THE INVENTION

Electro-hydraulic servovalves are typically used to control fluid flow (rate and direction) from a remote location. A valve of this type will often have multiple stages in which movement of a slide (also known as a spool) of a large valve is controlled through the movement of a much less massive pilot valve. An electrical actuator is usually connected to the pilot valve to control its operation.

There are two common forms of pilot valves used with heavy duty and/or high flow rate electro-hydraulic servovalves. The first type of pilot valve makes use of a movable plate that is located between opposed fluid orifices. Each orifice forms the end of a channel that contains pressurized fluid and that leads to one of two chambers located adjacent opposite sides of the main stage slide. When the plate located between the orifices is shifted by the electrical actuator, it blocks or partially blocks one or the other of the orifices. This causes an obstruction to the fluid exiting the affected orifice and thereby causes a pressure differential to be created in the chambers located adjacent to the ends of the main stage slide. This pressure imbalance causes the slide to shift within its cylinder.

The second type of pilot valve commonly used in heavy duty/high flow rate electro-hydraulic servovalves is very similar in general configuration to the servovalve's main stage valve. The pilot is made up of a slide/spool that is movable within a cylinder. An electrical actuator such as a torque motor is normally used to cause the translation of the pilot stage slide. As the pilot stage slide moves within its cylinder, it uncovers selected ports to thereby enable pressurized fluid to flow past the slide and cause a pressure imbalance to be created in chambers located adjacent opposite ends of the main stage slide. The pressure imbalance causes the main stage slide to shift in the desired direction.

Once the servovalve's main stage slide has been shifted through the action of the pilot valve, it is common for the servovalve to incorporate a feedback mechanism that can return the pilot and main stage valves to a neutral position. In the prior art, the feedback mechanism typically includes a portion that senses the position of either the main stage slide or the load. In addition, the feedback mechanism will employ either a mechanical or fluid connection to cause a repositioning of the pilot valve to thereby cause a rebalancing of the servovalve.

One problem with prior art electro-hydraulic servovalves is experienced when it is necessary or advantageous to adjust the feedback mechanism. In many prior art valves, adjustment of the feedback mechanism is extremely difficult or impossible. In some cases, the feedback mechanism is only accessible after significant disassembly of the valve that may include violating the valve's fluid boundary. If the valve is located in a sealed system, violating the fluid boundary to gain access to the feedback mechanism may necessitate retesting of the entire fluid system. Furthermore, the problematic accessibility of prior art feedback mechanisms significantly exacerbates their maintenance or repair.

A second problem with prior art servovalves that have feedback mechanisms arises due to the mechanism's contact with the system fluid. The fluid can cause corrosion of the mechanism, while entrained particles in the fluid can clog the narrow passages of a fluid-based feedback system or reduce the mobility of components in a mechanical-type feedback system.

A third problem with prior art electro-hydraulic servovalves involves hysteresis effects arising from the structural design of the feedback mechanism. These effects are associated with indirect coupling of the main and pilot stages of the valve and also frictional/dampening forces associated with the functioning of the feedback mechanism.

SUMMARY OF THE INVENTION

The invention is a multi-stage electro-hydraulic servovalve having a mechanical feedback between its main and pilot stages. The feedback mechanism makes use of interconnected linkages to transform linear movement of the main stage slide into a rotative movement of a torque rod that is operatively connected to a pilot stage slide.

The feedback mechanism is predominantly located exterior to the valve's pressure boundary. In the preferred embodiment, the exterior portion of the mechanism is readily accessible and includes at least two separate adjustment points. The accessible nature of the feedback mechanism enables easy adjustment, maintenance and/or repair of the mechanism. In addition, since most of the feedback mechanism is located outside of the fluid boundary, a major portion of the mechanism is not subject to any degradation of its functionality due to contact with the system fluid. In this manner, the invention minimizes the corrosion, contamination or clogging problems that can cause prior art systems to become inaccurate and/or non-functional.

The design of the feedback mechanism limits hysteresis effects by achieving a positive/direct connection between the main and pilot stages of the servovalve. The mechanism's interconnected system of linkages directly transfers the movement of the main stage slide into a movement of the pilot stage slide. The mechanism avoids the inexact functioning and/or high inertia that may be experienced with prior art systems. In addition, since a large percentage of the feedback mechanism is clearly viewable from a position exterior to the valve, it is easy to determine when the mechanism is working.

The feedback mechanism makes use of a position sensor that is secured to the center of the valve's main stage slide. In the preferred but not exclusive embodiment, a two-piece main stage slide is employed. The position sensor moves with the slide and is connected by a swing arm to a transfer member oriented perpendicularly to the longitudinal axis of the slide. The sensor's translation with the slide causes the transfer member to rotate about its axis. An outer end of the member is located exterior to the valve's pressure boundary and is connected to an adjustable length beam via an assembly that can be adjusted to control the gain of the feedback mechanism.

The adjustable length beam is used to set the feedback mechanism's null point and to compensate for changes in the gain of the feedback mechanism. The beam extends over the valve and is connected to linkage that is connected to the pilot stage valve via a torque rod. As the torque rod rotates in response to movement of the position sensor, it applies torque to a second torque/actuator rod located within the pilot stage valve. The interior torque/actuator rod has an eccentric cam-type end portion that is engaged to the pilot stage slide whereby rotation of the rod causes the pilot stage slide to shift in a direction opposite to that which caused the initial dislocation of the main stage slide.

DETAILED DESCRIPTION OF THE DRAWINGS

Figure 1:
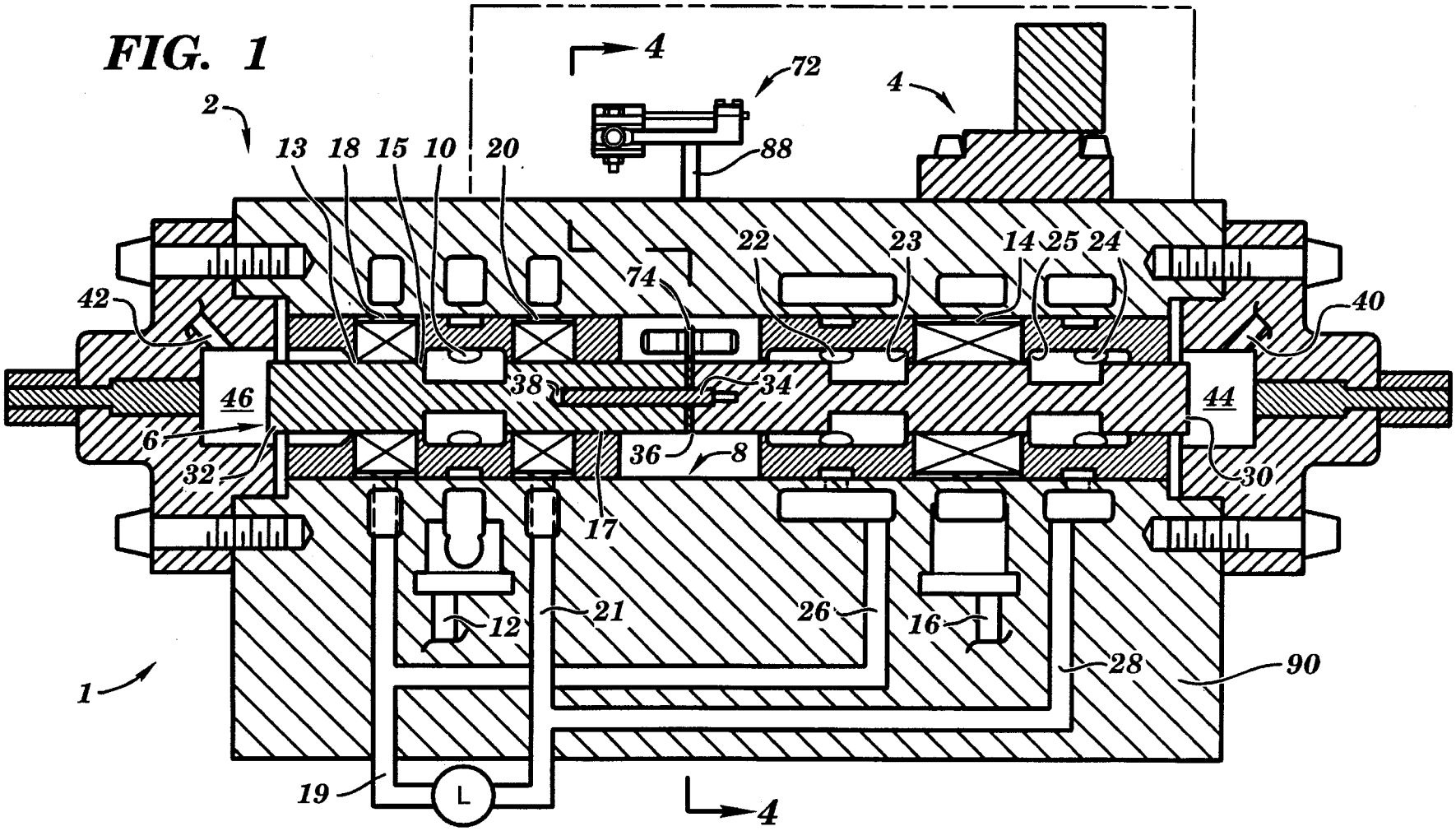
FIG. 1 is a side view, partially in cross-section, of a generalized electro-hydraulic servovalve that includes a feedback mechanism in accordance with the invention. In this view, only a portion of the feedback mechanism is shown.

Referring now to the drawings in greater detail, wherein like reference characters refer to like parts throughout the several figures, there is shown by the numeral 1 an electro-hydraulic servovalve in accordance with the invention.

Servovalve 1 includes a main stage valve 2 and a pilot stage valve 4. The main stage valve is composed of a two-part main slide or spool 6 that is contained within a cylindrical sleeve or cylinder 8. The sleeve features a plurality of ports 10 that lead to a supply of pressurized fluid (not shown) via channel 12. The sleeve also includes ports 14 that provide a return to the sump of the fluid supply via channel 16. Ports 18 (between lands 13 and 15) and 20 (between lands 15 and 17) in the sleeve lead to a load via lines 19 and 21 respectively. Sleeve ports 22 (adjacent land 23) and 24 (adjacent land 25) form the ends of return lines 26 and 28 respectively from said load.

As noted previously, slide 6 is a non-unitary structure and is composed of a first portion 30 and a second portion 32. Each portion may move independently of the other portion. During normal operation of the servovalve, the pilot pressure (as will be described shortly) forces the two portions of the slide together whereby they will move in unison. An elongated locator member 34 extends outwardly from end 36 of portion 30. The member is preferably collinear with the portion's axis. A complementary bore 38 is located in portion 32 and is designed to inwardly receive the member 34.

Located proximate one end of sleeve 8 is a fluid channel 40. A similar channel 42 is located proximate an opposite end of the sleeve 8. Each of channels 40 and 42 lead into an associated open area, 44 and 46 respectively, located adjacent to opposite ends of the slide 6. The channels are fluid passages that lead to the pilot valve 4.

Figure 2:
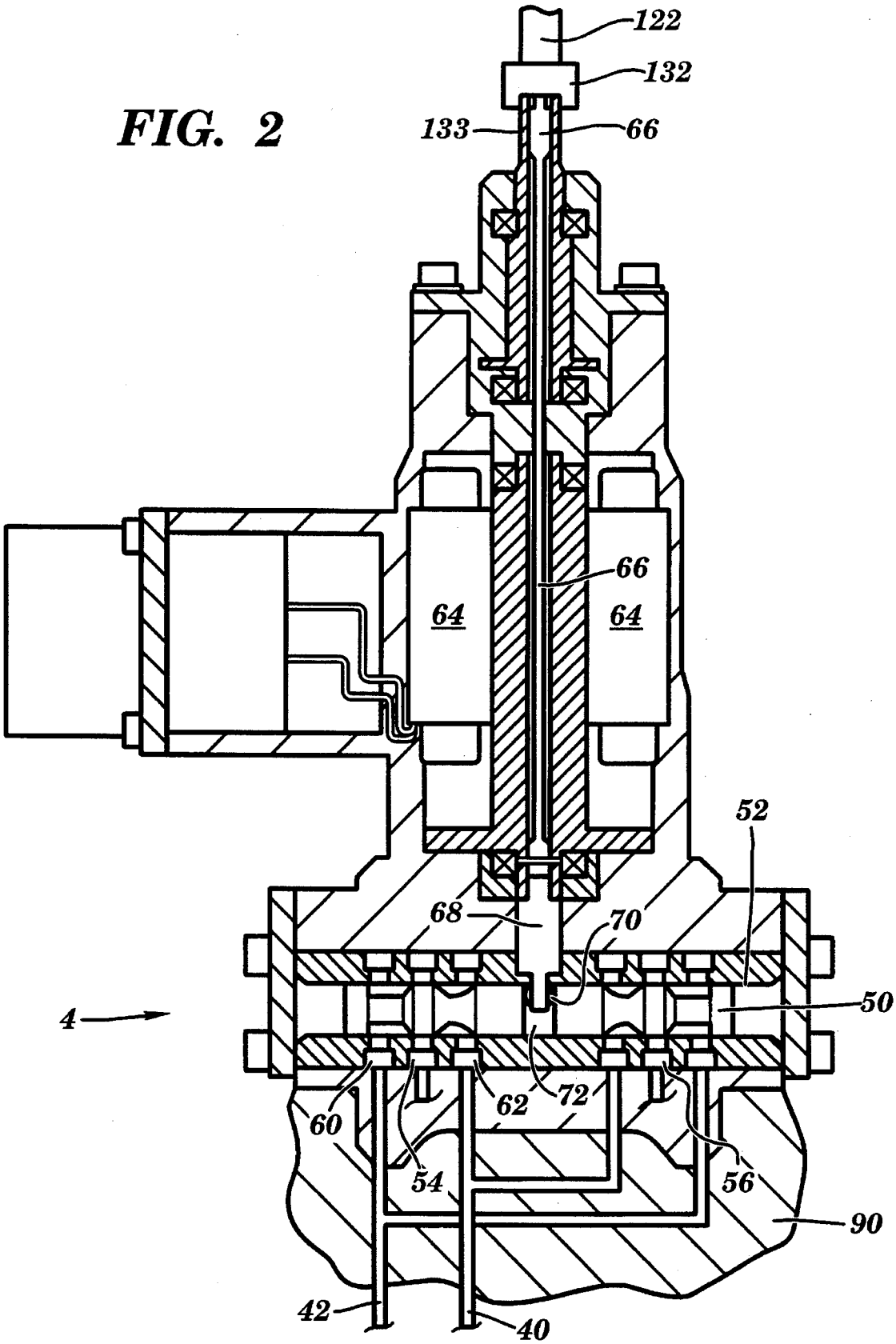
FIG. 2 is a detailed cross-sectional view of the pilot portion of the servovalve shown in FIG. 1.
Figure 3:
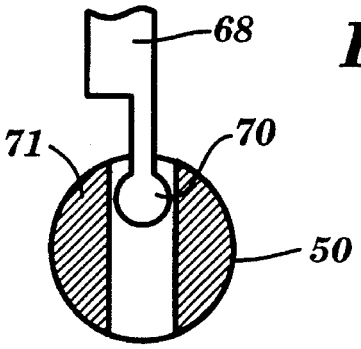
FIG. 3 is a detailed side view taken at 3—3 of the end portion of the pilot actuator rod shown in FIG. 2.

The pilot stage valve 4 is shown in detail in FIGS. 2 and 3. As shown, the valve includes a movable slide or spool 50 that is contained within a complementary sleeve or cylinder 52. The sleeve 52 includes a port 54 that leads to a source of pressurized fluid (not shown), a port 56 that leads to a return line for said fluid, and ports 60 and 62 that lead to the main stage valve 2 via passages 40 and 42, respectively.

As can be seen in the drawings, a torque motor 64 is operatively connected to the pilot stage valve 4. The torque motor functions to impart a rotary motion to a torque/actuator rod 66. Located in an offset manner at one end of member 68 (that is itself attached to rod 66) is a projection 70 (note FIG. 3) that is received within a centrally-located slot 71 in the pilot valve's slide 50. The offset location of the projection 70 enables it to function as a cam and to thereby cause translation of the pilot slide as the rod 66 is rotated by the torque motor. It is in this manner that an electrical signal transmitted to the torque motor is transformed into a shifting of the pilot stage slide 50.

When the slide 50 is shifted away from its central location, pressurized fluid is allowed to selectively enter one or the other of the passages 40 or 42. The pressurized fluid travels through the passage and then to the associated area 44 or 46 located adjacent an end of the main stage slide 6. The difference in pressure between areas 44 and 46 will cause the main stage slide 6 to translate within its associated sleeve 8. As a result, pressurized fluid will then be allowed to travel from port 10 to one of the load ports 18 or 20 to thereby cause the desired work to be achieved. It should be noted that translation of slide 6 also uncovers one of the return ports 22 or 24 to thereby allow fluid to return from the load to the sump via ports 14. As the main slide moves within its sleeve, an attached feedback mechanism 72 causes the pilot slide to be reset to its initial neutral position when the main stage slide is in its desired position.

Figure 4:
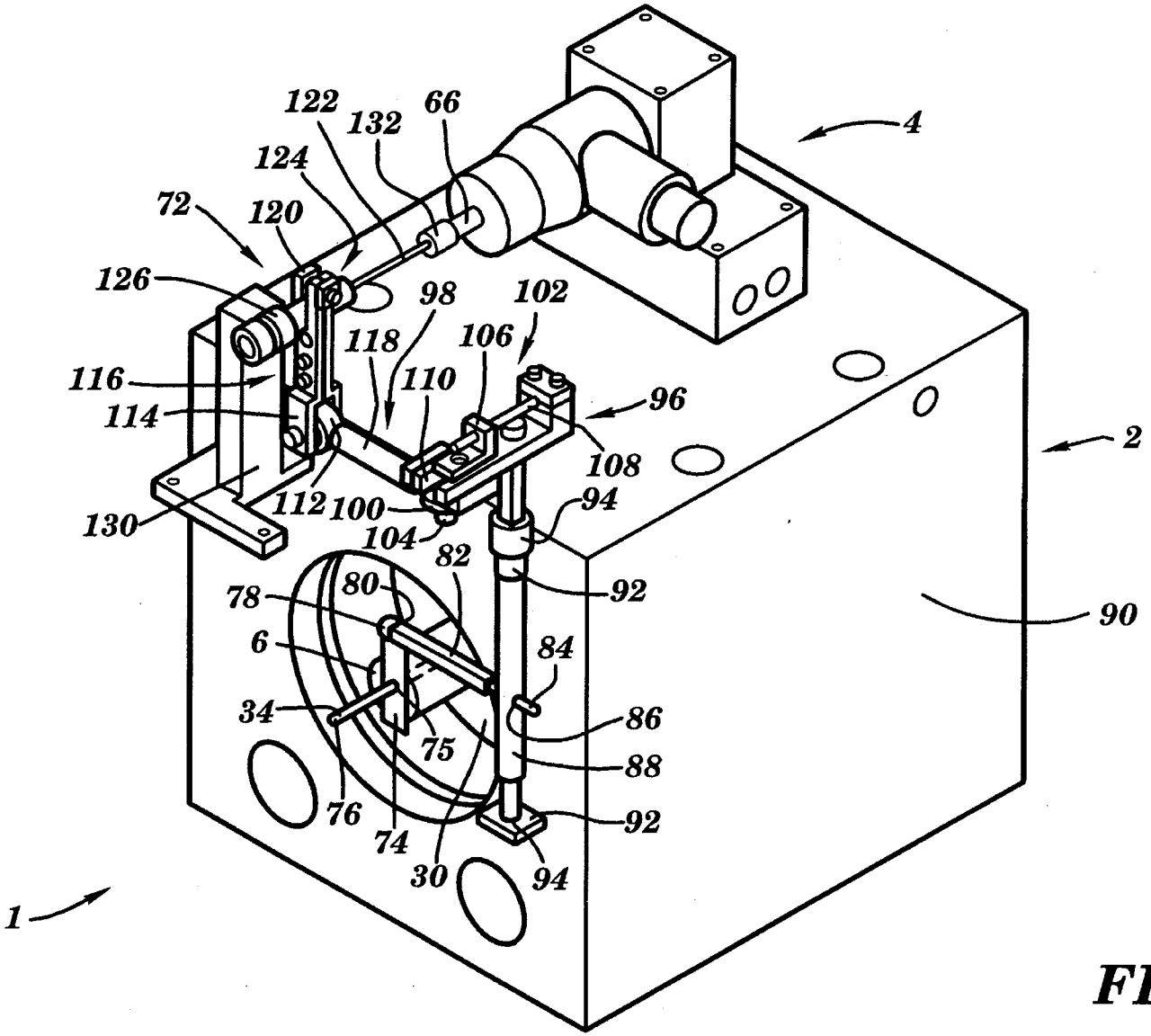
FIG. 4 is a perspective view of the rear half of the servovalve shown in FIG. 1.

The feedback mechanism 72 is shown in full in FIG. 4 and includes a drive plate 74 that is secured to the main stage slide 6. The drive plate is captured between the two portions 30, 32 of the slide and is secured to the slide via an aperture 75 through which the locator member 34 extends. The drive plate thereby acts as a position sensor that monitors the position of the slide 6 and moves in conjunction with said slide. The locator member 34 has a length whereby even if the two slide portions are forced apart by excessive pilot return pressure, the distal end 76 of the member will still be within the complementary bore 38 in portion 32 and thereby prevent any inadvertent detachment of the drive plate from the slide.

Located at the top of the drive plate is a connector 78 that pivotally connects the drive plate to an end 80 of a drive bar 82. The opposite end of the drive bar includes a reduced diameter portion 84 that is slidably received within a complementary aperture 86 in a vertically-oriented, rotatable transfer bar 88. The transfer bar is secured to the body 90 of the servovalve through upper and lower bearings 92. A fluid-tight seal 94 is located proximate each of the bearings and forms a portion of the valve's fluid boundary.

As the main stage slide 6 moves within its sleeve, the drive plate is similarly moved and the end 80 of the drive bar pivots on the drive plate. As the drive bar pivots on the drive plate, the bar sweeps an arcuate path about the transfer bar and causes the positionally fixed transfer bar to rotate. It should be noted that as the transfer bar is caused to rotate, the reduced diameter portion 84 of the drive bar will slide within the aperture of the transfer bar without becoming disengaged from said bar.

Mounted on the top end of the transfer bar and rotatable therewith is a gain adjust link 96. It should be noted that the link 96 is at a location that is exterior to the valve's fluid boundary. A first end portion 100 of a bearing link 98 is secured to an adjustable receiver mechanism 102 of the gain link. The receiver mechanism includes a fastener 104 that is directly attached to end portion 100 of the bearing link. The fastener is secured to a translation member 106 that can be adjustably positioned along a portion of the length of the gain adjust link. Repositioning of the translation member is achieved using fixed screw member 108 that, when rotated, moves the threadedly engaged translation member in a linear fashion. It should be noted that as the translation member moves, the fastener 104 slides within a complementary-sized slot 110. In this manner, one can adjust the arcuate distance that the fastener 104 (and attached link end portion 100) will travel per degree of rotation of the transfer bar by adjusting the length of the moment arm as measured between the fastener 104 and the longitudinal axis of the transfer bar. This adjustment may therefore be employed to change the feedback gain between the main and pilot stages of the servovalve.

Figure 7:
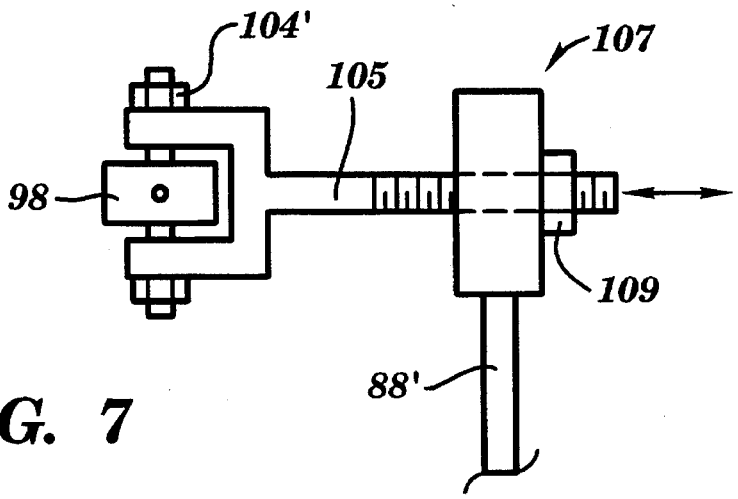
FIG. 7 is a side view of an alternate embodiment of the gain adjust link.

It should be noted that other equivalent structure can be employed in lieu of the described adjustable receiver mechanism. An example of an alternate embodiment of the receiver mechanism is provided in FIG. 7. In the shown alternate embodiment, fastener 104' is located on the end of a beam 105 that is secured to the top of the transfer bar by a clamp 107. Gain adjustment can then be achieved by changing the effective moment arm through loosening the clamp nut 109 and sliding the beam within the clamp to thereby bring the fastener 104 closer to or further away from the longitudinal axis of the transfer bar 88.

The structure of the bearing link 98 enables another adjustment of the feedback mechanism. The link's end portions, 100 and 112, are each in the form of a rod end bearing assembly that is connected to a center portion 118 of the link 98 by a threaded engagement. The threaded engagement employs a right-hand thread for one of the end bearing assemblies and a left-hand thread for the other of the end bearing assemblies. This allows a user to rotate the center portion 118 to thereby increase or decrease the overall length of the bearing link in much the same manner as would be practiced to adjust a conventional turnbuckle. The ability of a user to adjust the length of the bearing link 98 enables the user to adjust the mechanism's null point parameter and to adjust the feedback mechanism to compensate for changes in the gain adjustment.

End portion 112 of the bearing link 98 is connected to a first end 114 of a torsion drive link 116. The second end 120 of the torsion drive link is adjustably connected to the pilot drive torque rod 122 by a clamp apparatus 124. This adjustable securement provides a user with another point at which to adjust the null point and compensate for gain adjustment.

The pilot drive torque rod 122 is supported at one end by a bearing 126 that is connected to the valve body 90 by a support frame 130. The second end of rod 122 is connected to the actuator/torque rod 66 of the pilot stage of the servovalve via a clamp 132 that is secured to a rotatable member 133 that is fixedly attached to the rod 66. It should be noted that the torque rod 122 is semi-flexible whereby it can withstand a degree of flexion. In the preferred embodiment, the body of the torque rod is in the form of a thin metal rod in which its ends can be slightly rotated in opposite directions without permanently deforming the rod. Once the ends have been so twisted, the flexibility of the rod will cause the ends to return to their original positions. This allows the torque rod to also function as a spring that can be twisted and inherently will try to untwist to obtain its original state. This allows the actuator rod 66 to cause translation of the pilot stage slide without unduly applying a pressure on the main stage slide through the feedback mechanism. In the preferred embodiment of the invention, the portion of the torque/actuator rod 66 within the pilot stage is also in the form of a thin rod that is made of a metal, semi-flexible material that can be slightly twisted and act as a spring in the same manner as the torque rod 122.

It should be noted that once the main slide has been shifted within its sleeve, the feedback mechanism will apply a rotative moment on the torque rod to thereby cause the actuator rod 66 to rotate and return the pilot slide to its original null position. It should also be noted that the torque rod 122 and the actuator rod 66 work in concert to establish the proportional band of the valve as a function of feedback gain.

Figure 5:
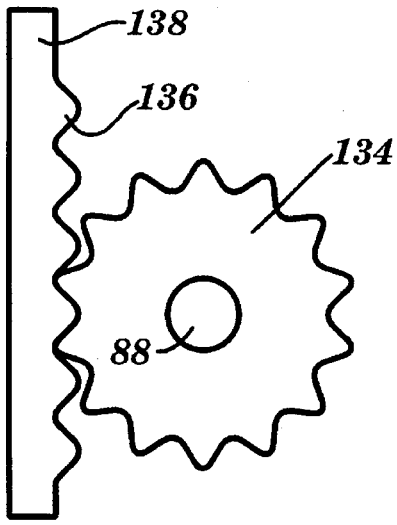
FIG. 5 provides a generalized view of a portion of a second embodiment of a feedback mechanism that can be employed in lieu of the equivalent portion of the feedback mechanism shown in FIGS. 1 and 4.
Figure 6:
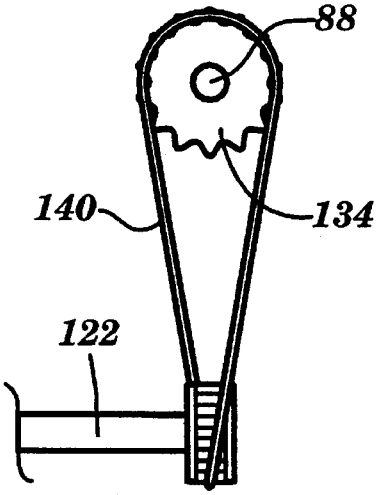
FIG. 6 provides a generalized view of a portion of a third embodiment of a feedback mechanism that can be employed in lieu of the equivalent portion of the feedback mechanism shown in FIGS. 1 and 4.

FIG. 5 provides a generalized view of a portion of a second embodiment of the feedback mechanism. While the invention, as previously described, makes use of interconnected linkages, it is considered within the scope of the invention to substitute various gear-type or other conventional assemblies for portions of the feedback mechanism. For example, FIG. 5 shows a gear 134 replacing the gain adjust link 96 of the previous embodiment. The gear is located atop the transfer bar and is engaged to complementary teeth 136 located on the side of a connecting link 138 that is analogous to bearing link 98. Gain adjustment of the mechanism can then be achieved by changing the diameter of gear 134 by replacing it with a larger or smaller gear. It should be noted that similar substitutions may be made for other portions of the feedback mechanism. In addition, portions of the feedback system can be eliminated and replaced by conventional motion transfer mechanisms (such as gears connected by chains, belts or threads) as shown in FIG. 6 in which a chain 140 is used to transfer the rotative movement of the transfer bar to the torque rod. However, the latter described embodiments would not provide a user with the adjustability and absolute direct connection between the main and primary stages of the servovalve as provided by the primary embodiment shown in FIGS. 1–4.

It should also be noted that while a two-part main stage slide 6 is shown, a unitary slide having a central slot could be substituted in its place. While one type of pilot valve 4 has been shown, other conventional types of pilot valves having movable members may be used in its place. In addition, the drive plate could be secured to the slide by a conventional fastener or by a sliding pin arrangement such as used to connect the drive bar 82 to the transfer bar 88. As another alternative, the drive plate may be secured by a conventional fastening method to an end of the slide 6.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. An electro-hydraulic servovalve comprising:

a main stage that includes a valve means having a slide means that is translatable within a complementary ported cylinder and controls delivery of pressurized fluid from a fluid supply to a load dependent on the location of the slide means within the cylinder;

a pilot stage that includes a valve means that is connected to the main stage in a manner whereby said pilot stage valve means is capable of creating an unbalanced force on at least one end of the main stage slide means to thereby cause said main stage slide means to translate within its associated cylinder;

an actuator that is operatively connected to and can affect the pilot stage valve means;

a feedback mechanism that is operatively connected to the main stage slide means and to the pilot stage valve means and functions to cause a change in the pilot stage valve means in response to movement of the main stage slide means and wherein said feedback mechanism includes a portion that is located exterior to a fluid boundary of the servovalve, wherein said exterior portion of the feedback mechanism includes an adjustment means and wherein the feedback mechanism has gain and null point parameters and wherein a user can employ said adjustment means to adjust at least one of said parameters; and wherein the feedback mechanism includes a drive plate that is engaged to the main stage slide means, wherein said feedback mechanism also includes a transfer bar that is rotatably secured to the servovalve and wherein a connecting means connects the drive plate to the transfer bar and causes said transfer bar to rotate as the main stage slide means moves in a linear manner within its associated cylinder.

2. The servovalve of claim 1 wherein the pilot stage valve means includes a slide means that is translatable within a complementary cylinder.

3. The servovalve of claim 2 wherein the actuator is operatively connected to the slide means of the pilot stage valve means by a rotatable actuator rod.

4. The servovalve of claim 3 wherein the feedback mechanism is connected to the rotatable actuator rod and includes means for transforming a linear movement of the main stage slide means into a rotative movement of said actuator rod.

5. The servovalve of claim 1 wherein the transfer bar is oriented substantially perpendicular to a longitudinal axis of the main stage cylinder.

6. The servovalve of claim 1 wherein the transfer bar is operatively connected by an adjustable connecting means to the pilot stage valve means, wherein said pilot stage valve means includes a movable portion, wherein movement of said movable portion causes an unbalanced pressure to be applied to the main stage slide means, and wherein said adjustable connecting means can be adjusted to vary an amount that said movable portion of the pilot stage valve means will move in response to a predetermined amount of rotational movement of the transfer bar.

7. The servovalve of claim 6 wherein the adjustable connecting means includes a gain adjust link that is secured to the transfer bar and is rotatable therewith and wherein said gain adjust link is adjustably connected to a movable member by a fastener means and wherein a position at which the fastener means is secured to the gain adjust link can be adjusted to thereby adjust a distance measurement between the fastener means and a longitudinal axis of the transfer bar.

8. The servovalve of claim 7 wherein the adjustable connecting means includes an adjustable-length member that can be adjusted by a user to change the null point parameter of the feedback mechanism.

9. The servovalve of claim 1 wherein the transfer bar is connected to a link member that is attached to one end of a torsion drive link and wherein a second end of said torsion drive link is connected to a rotatable torque rod in a manner wherein said torsion drive link is capable of moving about a longitudinal axis of said torque rod to thereby cause rotation of said torque rod.

10. The servovalve of claim 9 wherein the torsion drive link is adjustably connected to said torque rod.

11. The servovalve of claim 9 wherein said torque rod is connected to the pilot stage valve means.

12. The servovalve of claim 1 wherein the main stage slide means comprises first and second portions and wherein the feedback mechanism includes a position sensor that is located between said first and second portions of the main stage slide means and moves with said slide means.

13. The servovalve of claim 12 wherein the first portion of the main stage slide means includes a locator member that projects outwardly from an end of said portion.

14. The servovalve of claim 13 wherein the position sensor of the feedback mechanism is secured to said locator member.

15. The servovalve of claim 14 wherein the locator member is received within a complementary bore in the second portion of the main stage slide means.

16. The servovalve of claim 1 wherein the feedback mechanism includes a spring means to which force is applied when the pilot stage valve means is initially affected by the actuator.

17. The servovalve of claim 1 wherein the adjustment means of the feedback mechanism is capable of adjusting a gain parameter of the feedback mechanism.

18. The servovalve of claim 1 wherein the adjustment means of the feedback mechanism is capable of adjusting a null point parameter of the feedback mechanism.

19. An electro-hydraulic servovalve comprising:

a main stage that includes a valve means having a slide means, said slide means including first and second portions and wherein said first portion includes a locator member that extends outwardly from one end of said first portion and is slidably received within a complementary bore in the second portion, wherein said slide means is translatable within a complementary ported cylinder and controls delivery of pressurized fluid from a fluid supply to a load dependent on the location of the slide means within the cylinder;

a pilot stage that includes a valve means that is connected to the main stage in a manner whereby said pilot stage valve means is capable of creating an unbalanced force on at least one end of the main stage slide means to thereby cause said main stage slide means to translate within its associated cylinder;

an electrically-powered actuator that is operatively connected to and can affect the pilot stage valve means; and a feedback mechanism that is operatively connected to the main stage slide means and to the pilot stage valve means and wherein said feedback mechanism includes a position sensor adapted to move with the main stage slide means and wherein said position sensor is secured to the locator member of the main stage slide means by a securement means.

20. The servovalve of claim 19 wherein the securement means is in the form of an aperture in the position sensor through which the locator member of the main stage slide means extends.

21. An electro-hydraulic servovalve comprising:

a main stage that includes a valve means having a slide means that is translatable within a complementary ported cylinder and controls delivery of pressurized fluid from a fluid supply to a load dependent on the location of the slide means within the cylinder;

a pilot stage that includes a valve means, wherein said pilot stage valve means includes a slide means that is translatable within a complementary cylinder, wherein said pilot stage valve means is connected to the main stage in a manner whereby said pilot stage valve means is capable of creating an unbalanced force on at least one end of the main stage slide means to thereby cause said main stage slide means to translate within its associated cylinder;

an electrically-powered actuator that can affect the pilot stage valve means and is operatively connected to the slide means of the pilot stage valve means by a rotatable actuator rod; and a feedback mechanism that is operatively connected to the main stage slide means and to the pilot stage valve means and functions to cause a change in the pilot stage valve means in response to movement of the main stage slide means and wherein said feedback mechanism includes a portion that is located exterior to a fluid boundary of the servovalve, wherein said exterior portion of the feedback mechanism includes an adjustment means and wherein the feedback mechanism has gain and null point parameters and wherein a user can employ said adjustment means to adjust at least one of said parameters.

22. The servovalve of claim 21 wherein the feedback mechanism is connected to the rotatable actuator rod and includes means for transforming a linear movement of the main stage slide means into a rotative movement of said actuator rod.

23. An electro-hydraulic servovalve comprising:

a main stage that includes a valve means having a slide means that is translatable within a complementary ported cylinder and controls delivery of pressurized fluid from a fluid supply to a load dependent on the location of the slide means within the cylinder;

a pilot stage that includes a valve means that is connected to the main stage in a manner whereby said pilot stage valve means is capable of creating an unbalanced force on at least one end of the main stage slide means to thereby cause said main stage slide means to translate within its associated cylinder;

an electrically-powered actuator that is operatively connected to and can affect the pilot stage valve means; and a feedback mechanism that is operatively connected to the main stage slide means and to the pilot stage valve means and functions to cause a change in the pilot stage valve means in response to movement of the main stage slide means and wherein said feedback mechanism includes a portion that is located exterior to a fluid boundary of the servovalve, wherein said exterior portion of the feedback mechanism includes an adjustment means and wherein the feedback mechanism has gain and null point parameters and wherein a user can employ said adjustment means to adjust a gain parameter of the feedback mechanism.

24. The servovalve of claim 23 wherein the feedback mechanism includes a drive plate that is engaged to the main stage slide means.

25. An electro-hydraulic servovalve comprising:

a main stage that includes a valve means having a slide means that is translatable within a complementary ported cylinder and controls delivery of pressurized fluid from a fluid supply to a load dependent on the location of the slide means within the cylinder;

a pilot stage that includes a valve means that is connected to the main stage in a manner whereby said pilot stage valve means is capable of creating an unbalanced force on at least one end of the main stage slide means to thereby cause said main stage slide means to translate within its associated cylinder;

an electrically-powered actuator that is operatively connected to and can affect the pilot stage valve means;

a feedback mechanism that is operatively connected to the main stage slide means and to the pilot stage valve means and functions to cause a change in the pilot stage valve means in response to movement of the main stage slide means and wherein said feedback mechanism includes a portion that is located exterior to a fluid boundary of the servovalve, wherein said exterior portion of the feedback mechanism includes an adjustment means and wherein the feedback mechanism has gain and null point parameters and wherein a user can employ said adjustment means to adjust at least one of said parameters; and wherein the feedback mechanism includes a drive plate that is secured to the main stage slide means, wherein said feedback mechanism also includes a transfer bar that is rotatably secured to the servovalve and wherein a connecting means connects the drive plate to the transfer bar and causes said transfer bar to rotate as the main stage slide means moves in a linear manner within its associated cylinder.

* * * * *